US011255141B2

(12) United States Patent
Stuart et al.

(10) Patent No.: US 11,255,141 B2
(45) Date of Patent: Feb. 22, 2022

(54) POWER TONG WITH VERTICALLY PIVOTING DOOR

(71) Applicant: Eckel Manufacturing Co. Inc., Odessa, TX (US)

(72) Inventors: Randolph Lewis Stuart, Odessa, TX (US); Dwayne Austin Weddle, Odessa, TX (US)

(73) Assignee: Eckel Manufacturing Company, Inc., Odessa, TX (US)

( * ) Notice: Subject to any disclaimer, the term of this patent is extended or adjusted under 35 U.S.C. 154(b) by 0 days.

(21) Appl. No.: 15/757,603

(22) PCT Filed: Sep. 2, 2016

(86) PCT No.: PCT/US2016/050182
§ 371 (c)(1),
(2) Date: Mar. 5, 2018

(87) PCT Pub. No.: WO2017/040985
PCT Pub. Date: Mar. 9, 2017

(65) Prior Publication Data

US 2018/0252058 A1 Sep. 6, 2018

Related U.S. Application Data

(60) Provisional application No. 62/214,529, filed on Sep. 4, 2015.

(51) Int. Cl.
*E21B 19/16* (2006.01)

(52) U.S. Cl.
CPC ..... *E21B 19/164* (2013.01)

(58) Field of Classification Search
CPC ..... B25B 17/00; E21B 19/164
(Continued)

(56) References Cited

U.S. PATENT DOCUMENTS 4,401,000 A * 8/1983 Kinzbach ..... E21B 19/164 81/57.15
4,593,584 A 6/1986 Neves
(Continued)

FOREIGN PATENT DOCUMENTS

DE 10221874 A1 * 1/2003 ..... B25B 17/00

OTHER PUBLICATIONS

International Searching Authority (ISA); International Search Report and Written Opinion; dated Nov. 15, 2016.

*Primary Examiner* — Joseph J Hail
*Assistant Examiner* — Robert C Moore
(74) *Attorney, Agent, or Firm* — Patrick K. Steele

(57) ABSTRACT

A power tong having a door that pivots in a vertical plane that is parallel to a plane that includes the axis of the tubular being made up or broken down by the power tong. The door is pivotally coupled to a power tong body for movement between an open position, that allows a tubular joint to be introduced through a throat and into a bay of the power tong, and a closed position that closes the bay of the power tong to enable the gripping and rotating components of the power tong to be engaged to grip and rotate the tubular joint introduced into the power tong. The power tong door includes structures that are engaged upon pivotal closure of the door with corresponding structures on the power tong body.

6 Claims, 3 Drawing Sheets

(58) Field of Classification Search
USPC ..... 81/57.15, 81, 57.17–57.21, 57.2;
220/244, 810, 820, 833, 834, 798;
19/163, 16
See application file for complete search history.

(56) References Cited

U.S. PATENT DOCUMENTS

| | | | | |
|---|---|---|---|---|
| 6,058,811 | A * | 5/2000 | Stuart | E21B 19/164 81/57.15 |
| 6,279,426 | B1 | 8/2001 | Neves | |
| 2003/0177870 | A1* | 9/2003 | Neves | E21B 19/164 81/57.2 |

* cited by examiner

POWER TONG WITH VERTICALLY PIVOTING DOOR

STATEMENT OF RELATED APPLICATIONS

This application depends from and claims priority to PCT/US2016/050182 entitled Tong Door Securing Device filed on Sep. 2, 2016, which depends from and claims priority to U.S. Provisional Patent Application Ser. No. 62/214,529 filed on Sep. 4, 2015.

BACKGROUND

Field of the Invention

The present invention relates to a power tong for making up and breaking out threaded pipe connections of the kind used in oil and gas drilling and completion operations.

Background of the Related Art

Power tongs are devices that are used on a drilling rig or a workover rig to make up and break out threaded connections between adjacent joints of pipe joined together to form a tubular string. Power tongs grip and rotate a joint of pipe to threadably engage the joint of pipe onto an end of a tubular string. Alternately, power tongs grip and rotate a joint of pipe to threadably disengage the joint of pipe from an end of a tubular string.

BRIEF SUMMARY

One embodiment of the present invention provides a power tong comprising a body forming a bay into which a joint of pipe can be laterally introduced for gripping and rotating by components of the power tong, the power tong further including a vertically pivoting door that is pivotally coupled to the body and movable between an open position, to open the bay and permit introduction of a joint of pipe into the bay for being gripped and rotated, and a closed position to close the bay for operation of the gripping and rotating components of the power tong.

The door of the power tong has a pivotally coupled proximal end at which the door is pivotally secured to a body of the power tong on a first side of a throat which enters the bay of the power tong, and a latching distal end having one or more structures for use in securing the power tong door in the closed position. A first structure which may be included on the latching distal end of the vertically pivoting power tong door of the power tong is one of a curved protrusion and a curved groove that is shaped and positioned for being received into or, in the case of a curved groove, onto one of a correspondingly curved groove and a correspondingly curved protrusion on the power tong body to secure the power tong door in the closed position. It will be understood that the curvature of the one of a curved protrusion and a curved groove on the power tong door corresponds with the pivoting radius at which the one of a curved protrusion and a curved groove is disposed on the power tong door. Stated another way, the curvature of the one of the curved groove and curved protrusion on the power tong door, and the curvature of the corresponding other of the curved groove and curved protrusion on the power tong body, corresponds to the pivotal movement of the door at the distance on the door at which the one of a curved groove and a curved protrusion is disposed relative to a pivot pin or pivot bolt that secures the power tong door to the power tong body and about which the door pivots.

The power tong may further include a docking member positioned on the latching distal end of the power tong door to engage a corresponding docking member receptacle positioned on the power tong body. The docking member receptacle is shaped, sized and positioned on the power tong body to receive the docking member as it pivots to the closed position, and to provide an additional structure for securing the power tong door in the closed position. Optionally, the docking member may be disposed on the power tong body and the docking member receptacle may be disposed on the power tong door at a position to engage, upon movement of the door to the closed position, the docking member on the power tong body.

Optionally, the power tong body and the power tong door may each include an additional structure for securing the door in the closed position. The power tong door may, in one embodiment, include one of a radially interior curved groove and an interior curved protrusion disposed near the proximal end of the door and one of a correspondingly curved protrusion and a correspondingly curved groove disposed on the power tong body to receive and engage the one of the radially interior curved groove and interior curved protrusion as the power tong door is pivoted within a vertical plane about a pivot pin or pivot bolt to the closed position. It will be understood that these mating structures provide a more robust structure for securing the power tong door in the closed position, and these mating structures will result in a much lower load being applied to the pivot pin or pivot bolt.

DETAILED DESCRIPTION

Figure 1:
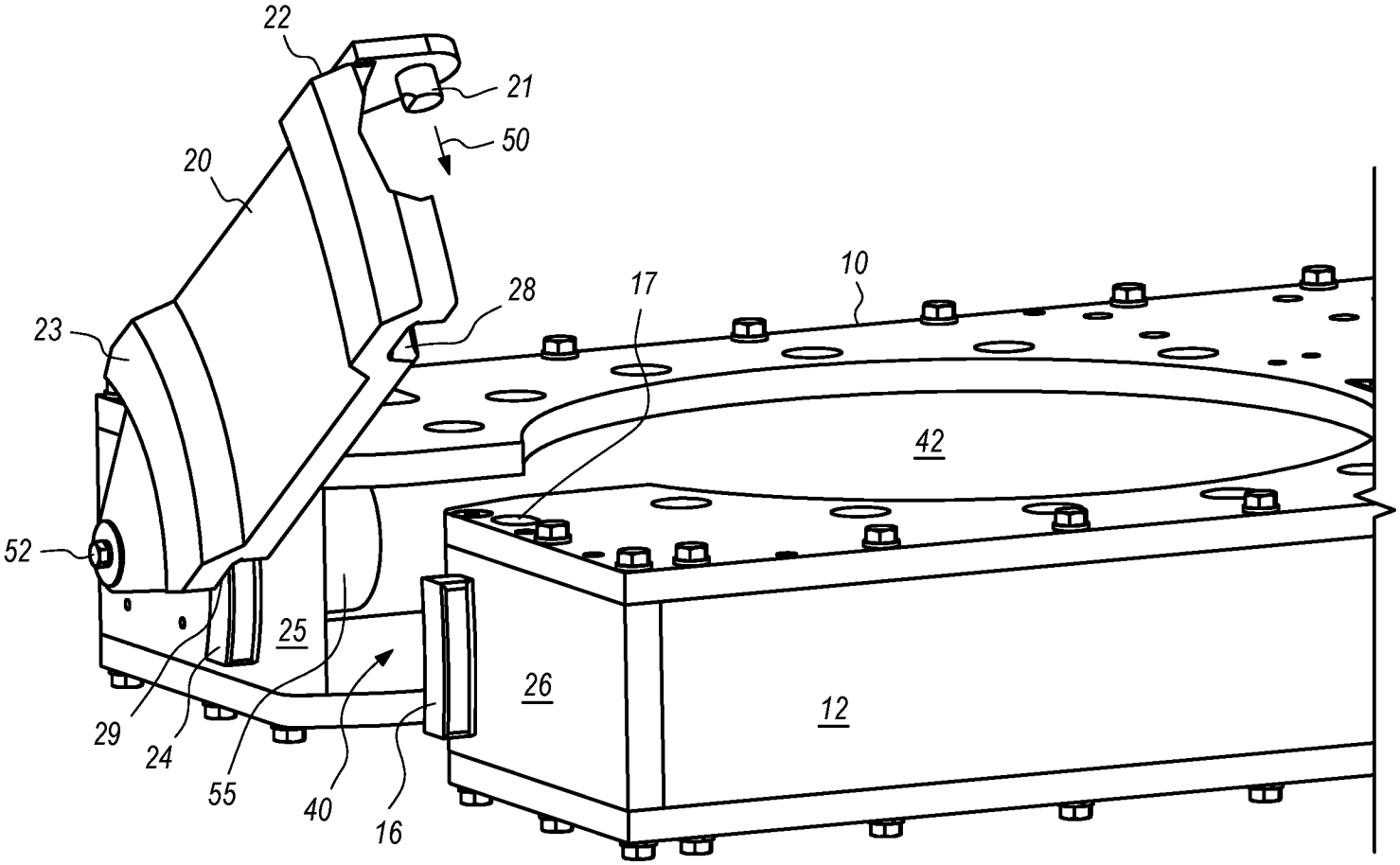
FIG. 1 is a perspective view of an embodiment of a power tong of the present invention equipped with a power tong door that is pivotally secured to a power tong body and which pivots within a vertical plane between an open position and a closed position, the power tong door being shown in a position intermediate the open position and the closed position.
Figure 2:
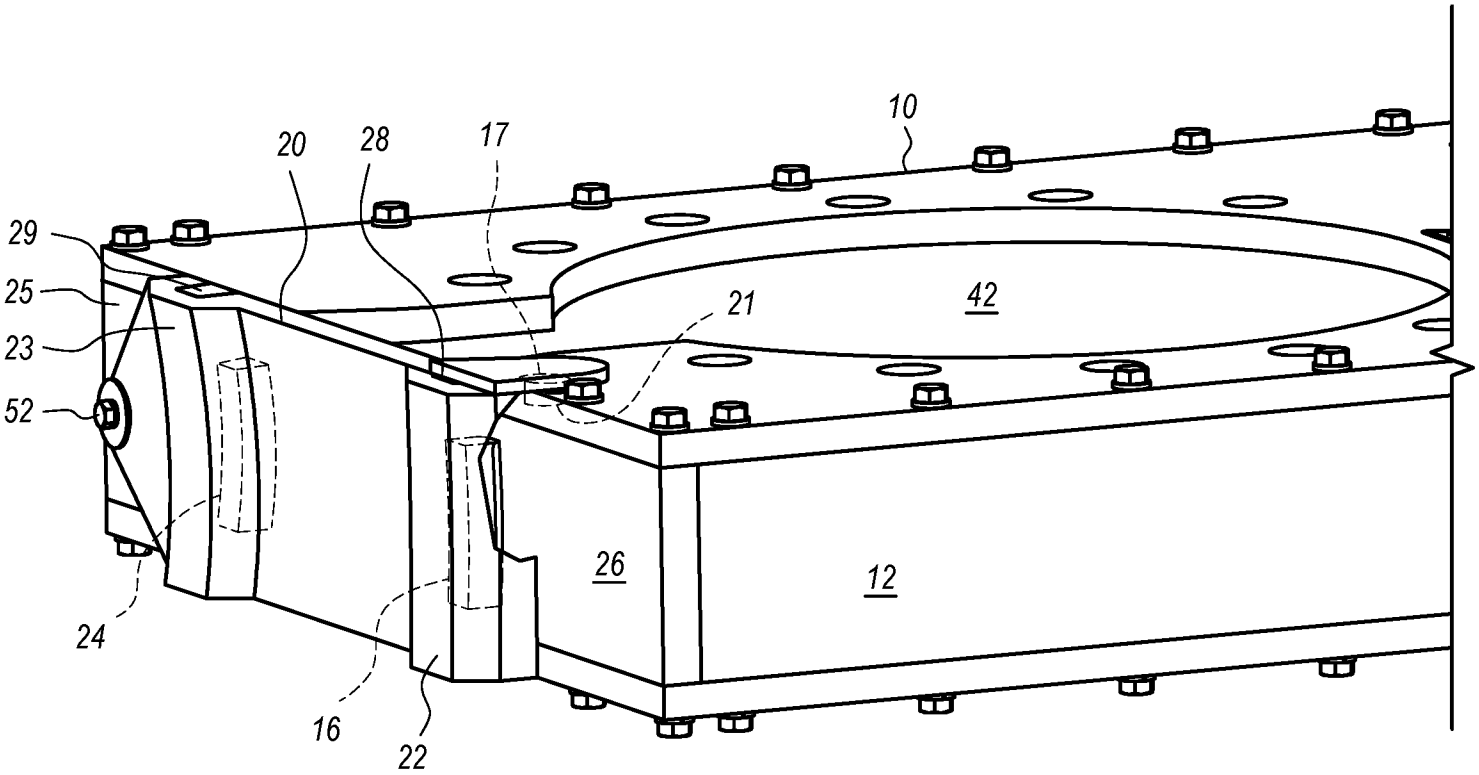
Figure 3:
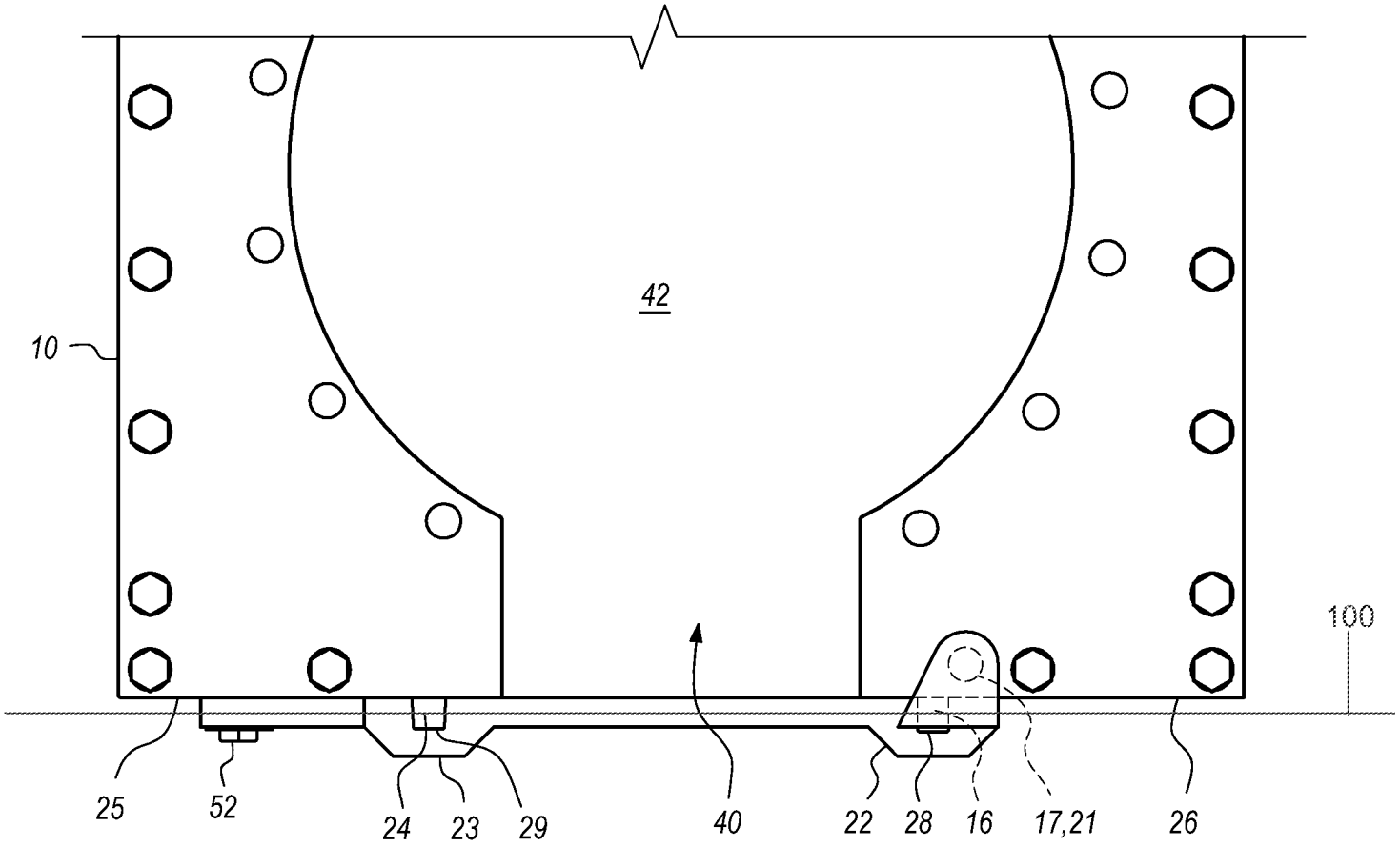

FIG. 1 is a perspective view of an embodiment of the power tong 10 of the present invention comprising a power tong body 12 forming a bay 42 into which a joint of pipe (not shown) can be laterally introduced for being gripped and rotated by components of the power tong 10, the power tong 10 further including a power tong door 20 that is pivotally coupled to the power tong body 12 using a horizontal pivot pin 52. The power tong door 20 is movable within a vertical plane between an open position, to open the throat 40 of the bay 42 and to thereby permit introduction of a joint of pipe (not shown) into the bay 42 for being gripped and rotated, and a closed position to close the bay 42 for operation of the gripping and rotating components of the power tong 10.

The power tong door 20 of the power tong 10 has a pivotally coupled proximal end 23 at which the door 20 is pivotally secured by the horizontal pin to a body 12 of the power tong 10 on a first side 25 of a throat 40 which enters the bay 42 of the power tong 10, and a latching distal end 22 having one or more structures for use in securing the power tong door 20 in the closed position. A first structure which is included on the latching distal end 22 of the pivoting power tong door of the power tong is a curved groove 28 that is shaped and positioned on the power tong door 20 for being received onto a correspondingly curved protrusion 16 on the second side 26 of the throat 40 and on the power tong body 10 to secure the power tong door 20 in the closed position. It will be understood that the curvature of the curved groove 28 on the power tong door 20 corresponds with the pivoting radius at which the curved groove 28 is disposed on the power tong door 20. Stated another way, the curvature of the curved groove 28 on the power tong door 20, and the curvature of the corresponding curved protrusion 16 on the power tong body 12, corresponds to the pivotal movement of the door 20 at the distance on the door 20 at which the curved groove 28 is disposed relative to the horizontal pivot pin or pivot bolt 52 that pivotally secures the power tong door 20 to the power tong body 12 and about which the door 20 pivots.

The embodiment of the power tong 10 of FIG. 1 may further include a docking member 21 positioned on the latching distal end 22 of the power tong door 20 to engage a corresponding docking member receptacle 17 positioned on the power tong body 12. The docking member receptacle 17 is shaped, sized and positioned on the power tong body 12 to receive insertion of the docking member 21 as it pivots within a vertical plane and in the direction of arrow 50 as the power tong door 20 pivots about the pivot bolt 52 to the closed position, and to provide an additional structure for securing the power tong door 20 in the closed position. Optionally, the docking member 21 may be disposed on the power tong body 12 and the docking member receptacle 17 may be disposed on the distal end 22 of the power tong door 20 at a position to engage, upon movement of the door 20 to the closed position, the docking member 21 on the power tong body 12.

Optionally, the power tong body 12 and the power tong door 20 may each include an additional structure for securing the door in the closed position. The power tong door 20 may, in one embodiment, include one of a radially interior curved groove 29 and the power tong body 12 may include a correspondingly curved protrusion 24 disposed near the proximal end 23 of the power tong door 20 to receive and engage the radially interior curved groove 29 of the power tong door 20 as the power tong door 20 is pivoted about a pivot bolt 52 to the closed position. It will be understood that these mating structures provide a more robust structure for securing the power tong door 20 in the closed position, and these mating structures will result in a much lower load being applied to the pivot bolt 52.

The power tong 10 may further comprise a motor 55 coupled to the door 20 to move the door 20 between the open position and the closed position. The motor 55 is preferably operated by the same hydraulic system that operates the gripping and rotating components of the power tong 10.

The motor 55 may, in one embodiment, be connected to operate the pivot member 52 or pivot bolt that is rotatably secured to the door 20 such that, upon actuation of the motor 55, the door 20 is repositioned from the open position to the closed position, or from the closed position to the open position.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A power tong, comprising:

a body having a bay therein to receive a vertical tubular joint and a throat providing access to and egress from the bay;

a door having a proximal end pivotally coupled to the body at a pivot member at a first side of the throat and a distal end, the door being pivotally coupled to the body for pivoting movement within a vertical plane and between an open position to allow lateral entry of the vertical tubular joint into the bay and a closed position to close the throat to enable gripping and rotating components of the power tong to grip and rotate the vertical tubular joint introduced into the bay;

at least one curved groove on the distal end of the door pivotally aligned to be engaged with and received onto a correspondingly curved protrusion on the body and on a second side of the throat as the door is pivoted within the vertical plane to the closed position; and at least one docking member on a distal end of the door aligned to be engaged with and received into a correspondingly shaped receptacle on the body and on a second side of the throat as the door is pivoted within the vertical plane to the closed position.

2. The power tong of claim 1, further comprising:

a second curved groove on the proximal end of the door aligned to be engaged with and received onto a correspondingly curved protrusion on the body and on the first side of the throat, intermediate the throat and the pivot member.

3. The power tong of claim 1, further comprising:

a motor coupled to the pivot member, the motor being actuatable to move the door within the vertical plane and between an open position and a closed position.

4. A power tong, comprising:

a body having a bay therein to receive a vertical tubular joint and a throat providing access to and egress from the bay;

a door having a proximal end pivotally coupled to the body at a pivot member at a first side of the throat and a distal end, the door being pivotally coupled to the body for pivoting movement within a vertical plane and between an open position to allow lateral entry of the vertical tubular joint into the bay and a closed position to close the throat to enable gripping and rotating components of the power tong to grip and rotate the vertical tubular joint introduced into the bay;

one of a curved docking member and a curved docking member receptacle disposed on the distal end of the door and pivotally aligned to be engaged with and received into a correspondingly curved other of the curved docking member and curved docking member receptacle disposed on the body and on a second side of the throat as the door is pivoted within the vertical plane to the closed position.

5. The power tong of claim 4, further comprising:

a protrusion on the distal end of the door, the protrusion directed orthogonally to an axis of the pivot member about which the door pivots; and a receptacle disposed on a top of the body and positioned to receive the protrusion as the door is pivoted within the vertical plane and about the pivot member to the closed position.

6. The power tong of claim 4, further comprising:

an auxiliary curved protrusion disposed on the body on the first side of the throat; and an auxiliary groove on the door positioned to slidably receive the auxiliary curved protrusion disposed on the body on the first side of the throat.

* * * * *